United States Patent [19]

Yamamoto

[11] 4,192,218

[45] Mar. 11, 1980

[54] FAIL-SAFE FLUID CONTROL VALVE

[75] Inventor: Toru Yamamoto, Gifu, Japan

[73] Assignee: Teijin Seiki Company Limited, Osaka, Japan

[21] Appl. No.: 873,500

[22] Filed: Jan. 30, 1978

Related U.S. Application Data

[63] Continuation-in-part of Ser. No. 722,757, Sep. 13, 1976, abandoned.

[30] Foreign Application Priority Data

Oct. 28, 1975 [JP] Japan ..... 50-129655

[51] Int. Cl.[2] ..... F01B 15/00; F15B 9/10

[52] U.S. Cl. ..... 91/216 A; 91/384; 91/436

[58] Field of Search ..... 91/384, 216 A

[56] References Cited

U.S. PATENT DOCUMENTS 2,597,419 5/1952 Westbury et al. ..... 91/216 A 2,922,400 1/1960 Lorence ..... 91/384

3,272,062 9/1966 Flippo et al. ..... 91/384

FOREIGN PATENT DOCUMENTS 2454259 5/1975 Fed. Rep. of Germany .

*Primary Examiner*—Paul E. Maslousky

*Attorney, Agent, or Firm*—Cushman, Darby & Cushman

[57] ABSTRACT

A fail-safe fluid control valve comprises a first sleeve accommodated in and fixed to a valve housing, a second sleeve slidably received in the first sleeve, and a valve spool slidably received in the second sleeve. The first and second sleeves are properly formed with grooves and ports while the valve spool is properly formed with spaced large diameter portions. When there occurs such an abnormal condition that the valve spool is jammed or stuck to the second sleeve, the second sleeve is axially moved in unison with the valve spool by an input lever for actuating the fail-safe control valve under the same condition as a normal condition in which the valve spool is axially moved by the input lever.

5 Claims, 8 Drawing Figures

FAIL-SAFE FLUID CONTROL VALVE

This is a Continuation-In-Part of Application, Ser. No. 722,757, filed Sept. 13, 1976 now abandoned.

This invention relates to a fail-safe fluid-control valve for use in aircrafts and the like, and more particularly to a control valve which can normally be operated under abnormal conditions such as troubles caused by jamming of the valves of the control valve or by the pressure oil source.

Such troubles of the control valve and the pressure oil source entails fatal accidents to the flight of the aircraft. These troubles are generally separated into primary and secondary troubles, the former indicating that a valve spool is jammed or stuck to a sleeve slidably embracing the valve spool due to foreign substances entered therebetween and that the valve spool is deformed due to heat expansion during its operation and thus unable to be moved in any direction, while the latter representing that no pressure oil is supplied to the control valve due to the troubles of the pressure oil source. It is thus generally required in the aircrafts such as helicopter and a small airplane not only to entirely avoid such accidents caused by the primary and secondary troubles but also to provide the control valve with an irreversible effect, thereby bringing about no operational failure by an attendant pilot. Conventionally, there have been proposed a variety of such fail-safe control valves all of which, however, have not overcome concurrently the above three problems.

It is therefore a primary object of the present invention to provide a fail-safe fluid-control valve which can satisfactorily be operated overcoming the above three problems even under an abnormal condition.

It is another object of the present invention to provide a fail-safe fluid control valve which has high reliability and is simple in construction.

In order to accomplish the foregoing objects, one embodiment of a fail-safe fluid control valve in accordance with the present invention comprises: a housing formed with a hollow cavity therein, a first sleeve securely accommodated in the hollow cavity of the housing, a second sleeve slidably accommodated in the first sleeve, a valve spool slidably accommodated in the second sleeve, an input lever pivotally connected at its longitudinally intermediate portion to the valve spool to axially move the valve spool, a pair of stop members disposed in spaced and opposing relation with the forward and backward faces of the longitudinally intermediate portion of the input lever to restrain movement of the longitudinally intermediate portion of the input lever over a predetermined distance, resilient means provided in the housing for resiliently retaining the second sleeve at a predetermined position and for resiliently returning the second sleeve to the predetermined position when the second sleeve is moved away from the predetermined position, a cylinder disposed in the vicinity of the hollow cavity of the housing and having a piston rod, one end of the input lever being connected to the piston rod, an inlet conduit communicated with the hollow cavity and having a first check valve to permit a pressure oil to be admitted into the hollow cavity through the check valve, a bifurcated outlet conduit communicated with the hollow cavity to permit the pressure oil to be discharged from the hollow cavity, a pair of cylinder conduits connecting the cylinder with the hollow cavity to permit the pressure oil to be admitted into the cylinder from the hollow cavity and to be discharged from the cylinder to the hollow cavity, whereby movement of any one of the piston rod of the cylinder and the housing causes the valve spool to be fed back to its original position and swinging motion of the input lever causes any one of the piston rod of the cylinder and the housing to be moved, the improvement characterized by: the valve spool including first, second, third and fourth large diameter portions located at predetermined intervals along its axial direction so as to define a first small diameter portion between the first and second large diameter portions, a second small diameter portion between the first and third large diameter portions, and a third small diameter portion between the second and fourth large diameter portions, the second sleeve including a first port group located in opposing relation with the first small diameter portion of the valve spool and having one or more radial bores circumferentially equi-distantly formed in the second sleeve, second and third port groups located in close proximity with each other and each having one or more radial bores circumferentially equi-distantly formed in the second sleeve, the radially inner openings of the radial bores of the second and third port groups being closable by the outer peripheral surface of the first large diameter portion of the valve spool, fourth and fifth port groups located in close proximity with each other and each having one or more radial bores circumferentially equi-distantly formed in the second sleeve, the fourth and fifth port groups being in spaced relation with the second and third port groups and the radially inner openings of the radial bores of the fourth and fifth port groups being closed by the outer peripheral surface of the second large diameter portion of the valve spool upon the radially inner openings of the radial bores of the second and third port groups being closed by the outer peripheral surface of the first large diameter portion of the valve spool, a sixth port group located in opposing relation with the second small diameter portion of the valve spool and having one or more radial bores circumferentially equi-distantly formed in the second sleeve, a seventh port group located in opposing relation with the third small diameter portion of the valve spool and having one or more radial bores circumferentially equi-distantly formed in the second sleeve, a first annular groove formed in the outer peripheral wall of the second sleeve to be in fluid communication with the radially outer openings of the radial bores of the first port group, a second annular groove formed in the outer peripheral wall of the second sleeve to be in fluid communication with the radially outer openings of the radial bores of the second port group, a third annular groove formed in the outer peripheral wall of the second sleeve to be in fluid communication with the radially outer openings of the radial bores of the third port group, a fourth annular groove formed in the outer peripheral wall of the second sleeve to be in fluid communication with the radially outer openings of the radial bores of the fourth port group, a fifth annular groove formed in the outer peripheral wall of the second sleeve to be in fluid communication with the radially outer openings of the radial bores of the fifth port group, a sixth annular groove formed in the outer peripheral wall of the second sleeve to be in fluid communication with the radially outer openings of the radial bores of the sixth port group, a seventh annular groove formed in the outer peripheral wall of the second sleeve to be in fluid communication with the radially outer openings of the radial bores of the seventh port group, the first sleeve including an eighth port group having one or more radial bores circumferentially equi-distantly formed in the first sleeve with their radially inner openings in fluid communication with the first annular groove, a ninth port group having one or more radial bores circumferentially equi-distantly formed in the first sleeve with their radially inner openings in fluid communication with the second and third annular grooves upon the second sleeve being retained at the predetermined position by the resilient means, a tenth port group having one or more radial bores circumferentially equi-distantly formed in the first sleeve with their radially inner openings in fluid communication with the fourth and fifth annular grooves upon the second sleeve being retained at the predetermined position by the resilient means, an eleventh port group having one or more radial bores circumferentially equi-distantly formed in the first sleeve with their radially inner openings in fluid communication with the sixth annular groove, a twelveth port group having one or more radial bores circumferentially equi-distantly formed in the first sleeve with their radially inner openings in fluid communication with the seventh annular groove, a thirteenth port group having one or more radial bores circumferentially equi-distantly formed in the first sleeve with their radially inner openings closed by the outer peripheral wall of the second sleeve and with the inner faces of the radial bores closely adjacent the eighth port group substantially radially aligned with the inner face of the first annular groove closely adjacent the third annular groove upon the second sleeve being retained at the predetermined position by the resilient means, a fourteenth port group having one or more radial bores circumferentially equi-distantly formed in the first sleeve with their radially inner openings closed by the outer peripheral wall of the second sleeve and with inner faces of the radial bores closely adjacent the eighth port group substantially radially aligned with the inner face of the first annular groove closely adjacent the fifth annular groove upon the second sleeve being retained at the predetermined position by the resilient means, an eighth annular groove formed in the outer peripheral wall of the first sleeve to be in fluid communication with the radially outer openings of the radial bores of the eighth port group, a ninth annular groove formed in the outer peripheral wall of the first sleeve to be in fluid communication with the radially outer openings of the radial bores of the ninth and thirteenth port groups and one of the cylinder conduits, a tenth annular groove formed in the outer wall of the first sleeve to be in fluid communication with the radially outer openings of the radial bores of the tenth and fourteenth port groups and the remaining cylinder conduit, an eleventh annular groove formed in the outer peripheral wall of the first sleeve to be in fluid communication with the radially outer openings of the radial bores of the eleventh port group and the outlet conduit, and a twelveth annular groaove formed in the outer peripheral wall of the first sleeve to be in fluid communication with the radially outer openings of the radial bores of the twelveth port group and the outlet conduit; a by-pass conduit having both ends connected with the cylinder conduits and accommodating therein a pair of second check valves, the by-pass conduit being fluidally communicated at its longitudinal position between the second check valves with the eighth annular groove of the first sleeve.

The features and advantages of the fail-safe fluidcontrol valve according to the present invention will become more apparent from the following description taken in conjunction with the accompanying drawings, in which.

Figure 1:
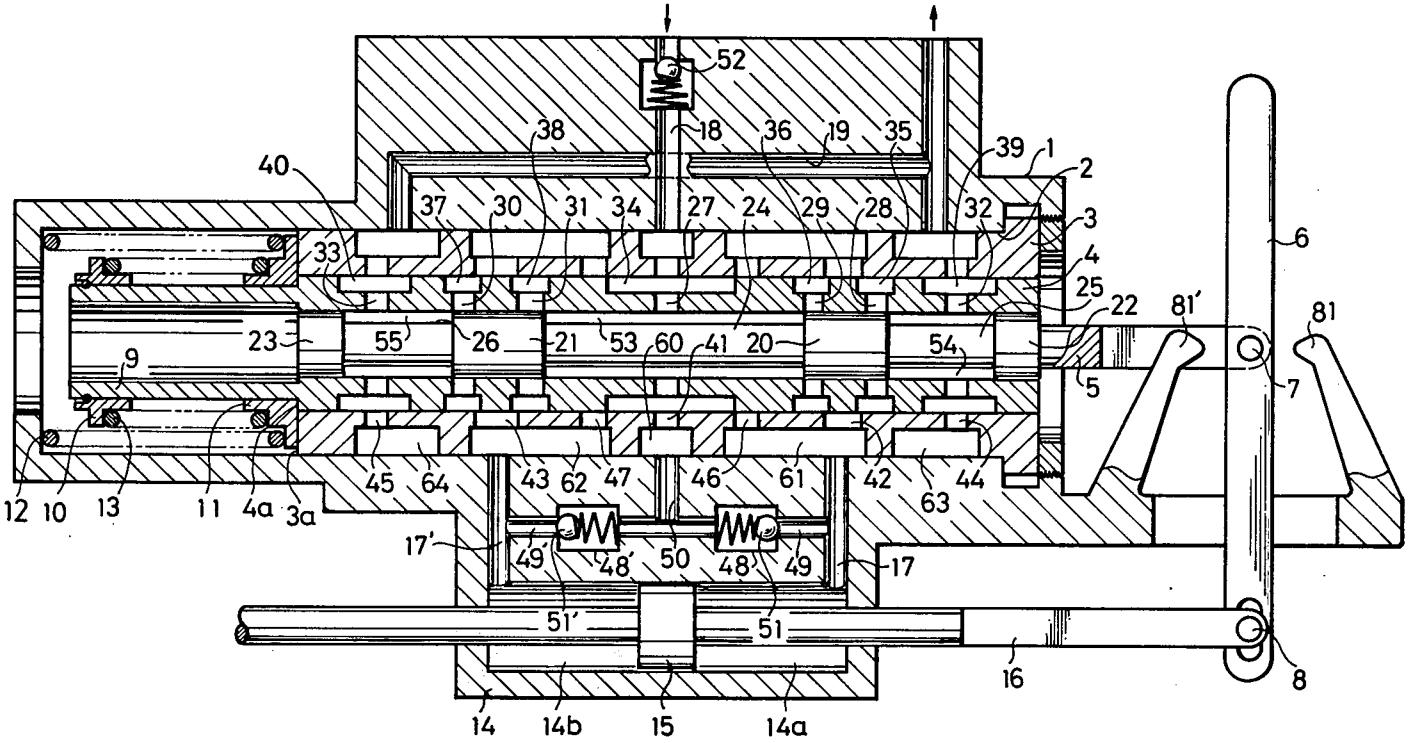
FIG. 1 is a cross-sectional view of a preferred embodiment of the fail-safe fluid control valve according to the present invention and showing a null position in a normal condition thereof.

Referring now to the drawings and in particular to FIG. 1, the reference numeral 1 designates a housing which is provided with a laterally extending hollow cavity 2. Within the hollow cavity 2 is securely accommodated a first sleeve 3 which slidably receives a second sleeve 4 slidably accommodating therein a valve spool 5. The right end of the spool 5 is pivotally connected to the longitudinally intermediate portion of an input lever 6 by means of a pin member 7. The input lever 6 is pivotally and slidably connected at its lower end to the right end of a piston rod, as will be described hereinlater in detail, by means of a pin member 8 so that the locking motion of the input lever 6 around the pin member 8 causes the valve spool 5 to axially be reciprocated. The second sleeve 4 has at its left end a horizontal cylindrical projection 9 which has a radial lodge **4*a* formed at a connecting point between the cylindrical projection 9 and the sleeve 4. The cylindrical projection 9 has a fore end which securely supports a fixed collar 10. A movable collar 11 is slidably received on the cylindrical projection 9 between the radial ledge 4*a* and the fixed collar 10. A first compression coil spring 12 is accommodated in the left portion of the hollow cavity 2 to urge the movable collar 11 rightwardly so that the right face of the movable collar 11 is normally brought into engagement with the left face 3*a* of the first sleeve 3. A second compression coil spring 13 is so provided as to surround the cylindrical projection 9 between the fixed collar 10 and the movable collar 11 and inside of the first compression coil spring 12 so that the second compression coil spring 13 serves to urge the movable collar 11 rightwardly, thereby bringing the right face of the movable collar 11 into engagement with the radial ledge 4*a*. The first compression coil spring 12 and the second compression coil spring 13 have substantially the same spring constant, whereby the right face of the movable collar 11 is held in engagement with the left face 3*a* of the first sleeve 3 and the radial ledge 4*a* of the second sleeve 4 without any external force excerted upon the second sleeve 4 as shown in FIG. 1 while the second sleeve 4 resumes the position as shown in FIG. 1 upon the second sleeve 4 being moved in either left or right direction away therefrom with the external force exerted upon the second sleeve 4**.

Formed integrally with the housing 1 is a cylinder 14 within which a piston 15 is slidably accommodated and secured to a piston rod 16. The both ends of the cylinder 14 are connected to one ends of cylinder conduits 17 and 17' which have the other ends as will be described in detail hereinlater. An inlet conduit 18 and a bifurcated outlet conduit 19 are formed in the housing 1 and their connection will also be described in detail hereinafter. The valve spool 5 has first, second, third and fourth large diameter portions 20, 21, 22 and 23 located at predetermined intervals along its axial direction so as to define a first small diameter portion 24 between the first and second large diameter portions 20 and 21, a second small diameter portion 25 between the first and third large diameter portions 20 and 22, and a third small diameter portion 26 between the second and fourth large diameter portions 21 and 23. A first port group 27 is located in opposing relation with the first small diameter portion 24 and consists of one or more radial bores circumferentially equi-distantly formed in the second sleeve 4. Second and third port groups 28 and 29 are located in close proximity with each other and each consists of one or more radial bores circumferentially equi-distantly formed in the second sleeve 4, the radially inner openings of the radial bores of the second and third port groups 28 and 29 being closable by the outer peripheral surface of the first large diameter portion 20 of the valve spool 5. Fourth and fifth port groups 30 and 31 are also located in close proximity with each other and each consists of one or more radial bores circumferentially equi-distantly formed in the second sleeve 4. The fourth and fifth port groups 30 and 31 are in spaced relation with the second and third port groups 28 and 29 and radially inner openings of the radial bores of the fourth and fifth port groups 30 and 31 are closed by the outer peripheral surface of the second large diameter portion 21 of the valve spool 5 when the radially inner openings of the radial bores of the second and third port groups 28 and 29 are closed by the outer peripheral surface of the first large diameter portion 20 of the valve spool 5. A sixth port group 32 is located in opposing relation with the second small diameter portion 25 of the valve spool 5 and consists of one or more radial bores circumferentially equi-distantly formed in the second sleeve 4. A seventh port group 33 is located in opposing relation with the third small diameter portion 26 of the valve spool 5 and consists of one or more radial bores circumferentially equi-distantly formed in the second sleeve 4. A first annular groove 34 is formed in the outer peripheral wall of the second sleeve 4 to be in fluid communication with the radially outer openings of the radial bores of the first port group 27. Second and third annular grooves 35 and 36 are formed in the outer peripheral wall of the second sleeve 4 to be in fluid communication with the radially outer openings of the radial bores of the second and third port groups 28 and 29, respectively. Fourth and fifth annular grooves 37 and 38 are formed in the outer peripheral wall of the second sleeve 4 to be in fluid communication with the radially outer openings of the radial bores of the fourth and fifth port groups 30 and 31, respectively. A sixth annular groove 39 is formed in the outer peripheral wall of the second sleeve 4 to be in fluid communication with the radially outer openings of the radial bores of the sixth port group 32, while a seventh annular groove 40 is formed in the outer peripheral wall of the second sleeve 4 to be in fluid communication with the radially outer openings of the radial bores of the seventh port group 33.

An eighth port group 41 consists of one or more radial bores circumferentially equi-distantly formed in the first sleeve 3 with their radially inner openings in fluid communication with the first annular groove 34. A ninth port group 42 consist of one or more radial bores circumferentially equi-distantly formed in the first sleeve 3 and the radially inner openings of the bores are in fluid communication with the second and third annular grooves 35 and 36 when the second sleeve 4 is retained at the predetermined position by means of the first and second compression coil springs 12 and 13. A tenth port group 43 consists of one or more radial bores circumferentially equi-distantly formed in the first sleeve 3 and the radially inner openings of the bores are in fluid communication with the fourth and fifth annular grooves 37 and 38 when the second sleeve 4 is retained at the predetermined position by means of the first and second compression coil springs 12 and 13. An eleventh port group 44 consists of one or more radial bores circumferentially equi-distantly formed in the first sleeve 3 with their radially inner openings in fluid communication with the sixth annular groove 39. A twelveth port group 45 consists of one or more radial bores circumferentially equi-distantly formed in the first sleeve 3 with their radially inner openings in fluid communication with the seventh annular groove 40. A thirteenth port group 46 consists of one or more radial bores circumferentially equi-distantly formed in the first sleeve 3, and the radially inner openings of the bores are closed by the outer peripheral wall of the second sleeve 4, the inner faces of the radial bores 46 closely adjacent the eighth port group 41 being substantially radially aligned with the inner face of the first annular groove 34 closely adjacent the third annular groove 36 when the second sleeve 4 is retained at the predetermined position by means of the first and second compression coil springs 12 and 13. A fourteenth port group 47 consists of one or more radial bores circumferentially equi-distantly formed in the first sleeve 3, and the radially inner openings of the bores are closed by the outer peripheral wall of the second sleeve 4, the inner faces of the radial bores closely adjacent the eighth port group 41 being substantially radially aligned with the inner face of the first annular groove 34 closely adjacent the fifth annular groove 38 when the second sleeve 4 is retained at the predetermined position by means of the first and second compression coil springs 12 and 13. An eighth annular groove 60 is formed in the outer peripheral wall of the first sleeve 3 to be in fluid communication with the radially outer openings of the radial bores of the eighth port group 41. A ninth annular groove 61 is formed in the outer peripheral wall of the first sleeve 3 to be in fluid communication with the radially outer openings of the radial bores of the ninth and thirteenth port groups 42 and 46. A tenth annular groove 62 is formed in the outer peripheral wall of the first sleeve 3 to be in fluid communication with the radially outer openings of the radial bores of the tenth and fourteenth port groups 43 and 47. An eleventh annular groove 63 is formed in the outer peripheral wall of the first sleeve 3 to be in fluid communication with the radially outer openings of the radial bores of the eleventh port group 44. A twelveth annular groove 64 is formed in the outer peripheral wall of the first sleeve 3 to be in fluid communication with the radially outer openings of the radial bores of the twelveth port group 45. The following spaces are each made shorter than the axial length of each of the radial bores of the second, third, fourth and fifth port groups 28,29, 30 and 31 and preferably are half the above axial length. The above spaces includes a space held between the left face of the second annular groove 35 and the right faces of the radial bores of the ninth port group 42, a space held between the right face of the third annular groove 36 and the left faces of the radial bores of the ninth port group 42, a space held between the right face of the fourth annular groove 37 and the left faces of the radial bores of the tenth port group 43, and a space held between the left face of the fifth annular groove 38 and the right faces of the radial bores of the tenth port group 43 when the second sleeve 4 is retained at the predetermined position by means of the first and second compression coil springs 12 and 13 as shown in the state of FIG. 1. The cylinder conduits 17 and 17' are connected at the other ends to the ninth and tenth annular grooves 61 and 62. The inlet conduit 18 is communicated with the eighth annular groove 60, while the outlet conduit 19 is bifurcatedly communicated with the eleventh and twelveth annular grooves 63 and 64. Within the housing 1 are formed a pair of valve chambers 48 and 48', the former being connected with the cylinder conduit 17 by a by-pass conduit 49 while the latter being connected with the cylinder conduit 17' by a by-pass conduit 49'. A by-pass conduit 50 is formed within the housing 1, having one end connected to the eighth annular groove 60 and the other end bifurcatedly connected to the valve chambers 48 and 48'. A check valve 51 is housed in the valve chamber 48 to normally close the by-pass conduit 49, while another check valve 51' is housed in the valve chamber 48' to normally close the by-pass conduit 49'. A check valve 52 is housed in the inlet conduit 18 to normally close the inlet conduit 18. A pair of stop member 81 and 81' are integrally formed with the housing 1 to be disposed in spaced and opposing relation with the forward and backward faces of the longitudinally intermediate portion of the input lever 6 so that the axial movement of the input lever 6 can be restrained by the stop members 81 and 81' within the distance defined thereby.

The operation of the fail-safe control valve of the present invention thus constructed and arranged will be described hereinafter.

FIG. 1 shows a null position of the fail-safe control valve embodying the present invention with the input lever 6 held in a substantially vertical direction. In this stae, the radial bores of the second and third port groups 28 and 29 are closed by the outer peripheral wall of the large diameter portion 20 of the valve spool 5, while the radial bores of the fourth and fifth port groups 30 and 31 are closed by the outer peripheral wall of the large diameter portion 21 of the valve spool 5. On the other hand, the second sleeve 4 is retained by the first and second compression coil springs 12 and 13 at the predetermined position where the movable collar 11 is held in engagement with the face 3*a* of the first sleeve 3 and the radial ledge 4*a* of the second sleeve 4. No pressure oil is fed into and discharged from the cylinder conduits 17 and 17' although it is supplied into an annular chamber 53 defined by the large diameter portions 20, 21, the small diameter portion 24 and the inner peripheral wall of the second sleeve 4 from the inlet conduit 18 through the check valve 52, the eighth annular groove 60, the radial bores of the eighth port group 41, the first annular groove 34 and the radial bores of the first port group 27. The piston 15 and the piston rod 16 are thus held under a null condition as shown in FIG. 1. As a result of this, the piston 15 and the piston rod 16 are not moved in either left or right direction causing irreversible effect even if any external force is excerted on the piston 15 and the piston rod 16 to urge them in either left or right direction.

Figure 2:
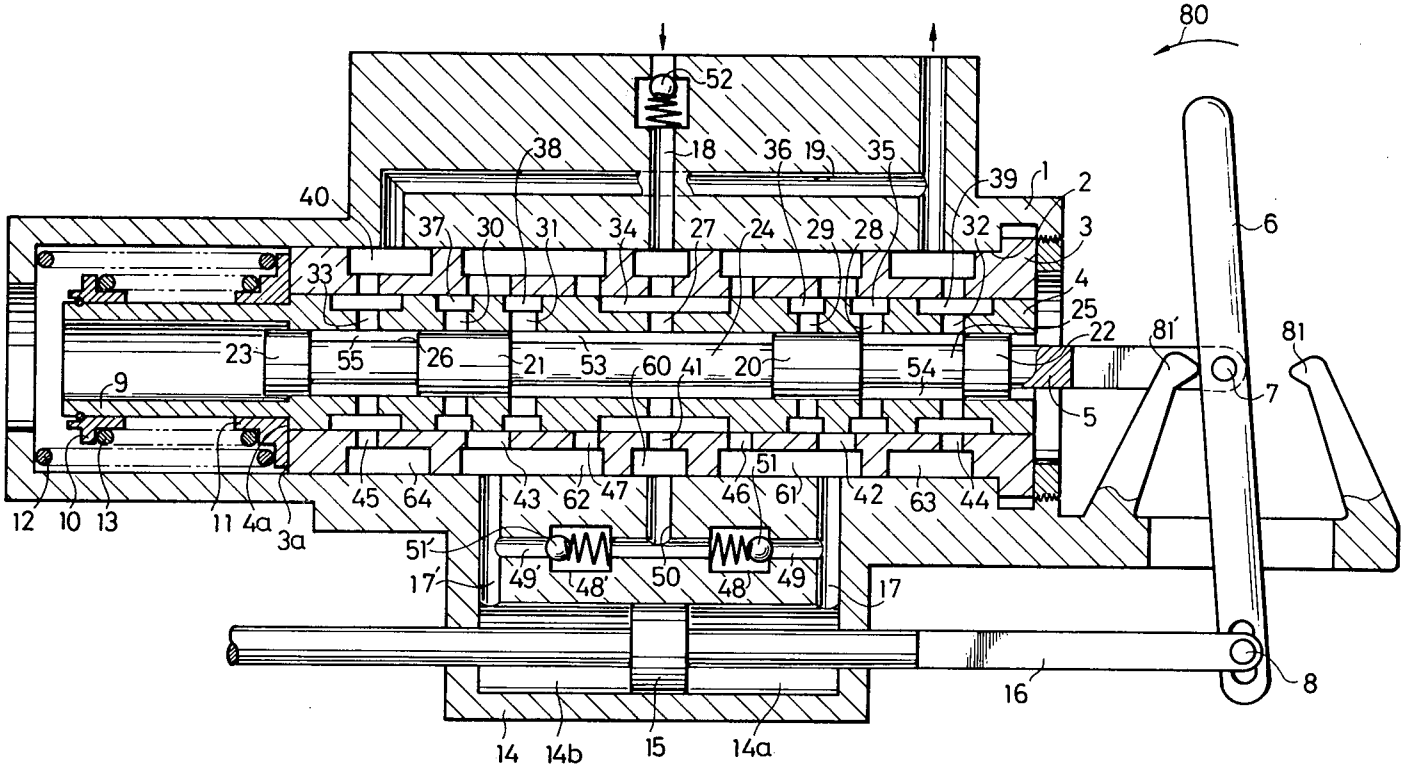
FIG. 2 is a cross-sectional view similar to FIG. 1 but showing a condition under which a valve spool is moved leftwardly.

When the input lever 6 is then swung around the pin member 8 in the direction of an arrow 80 as shown in FIG. 2, the valve spool 5 is moved leftwardly from the position of FIG. 1 until the large diameter portions 20 and 21 open the radial bores of the second and fifth port groups 28 and 31, respectively. At this time, the radial bores of the third and fourth port groups 29 and 30 remain closed by the large diameter portions 20 and 21, respectively. Under these conditions, the pressure oil supplied into the annular chamber 53 from the inlet conduit 18 is admitted into the left chamber 14*b* of the cylinder 14 through the radial bores of the fifth port group 31, fifth annular groove 38, the radial bores of the tenth port group 43, the tenth annular groove 62 and the cylinder conduit 17', while the pressure oil in the right chamber 14*a* of the cylinder 14 is discharged into the outlet conduit 19 through the cylinder conduit 17, the ninth annular groove 61, the radial bores of the ninth port group 42, the second annular groove 35, the radial bores of the second port group 28, an annular chamber 54 defined by the large diameter portions 20 and 22, the small diameter portion 25 and the inner peripheral wall of the second sleeve 4, the radial bores of the sixth port group 32, the sixth annular groove 39, the radial bores of the eleventh port group 44, and the eleventh annular groove 63. This permits the piston 15 and the piston rod 16 to be moved rightwardly. When the piston rod 16 is moved rightwardly, the feed-back effect caused by the connection between the input lever 6, the valve spool 5 and the piston rod 16 allows the input lever 6 to be swung around the upper end thereof to make the valve spool 5 to be moved rightwardly so that the valve spool 5 and the piston rod 16 are stopped and the valve spool 5 and the second sleeve 4 resume the state, i.e., the null position as shown in FIG. 1. When the input lever 6 is then swung around the pin member 8 in a direction opposite to the arrow 80, the piston rod 16 is moved leftwardly and thereafter stopped to resume the above null position in a similar manner as above.

While there has been described about normal state operations under which the valve spool 5 is not jammed or stuck to the second sleeve 4, the following operations will be performed in the event that such the normal state operations cannot be carried out due to jamming of the valve spool 5 and the second sleeve 4.

Figure 3:
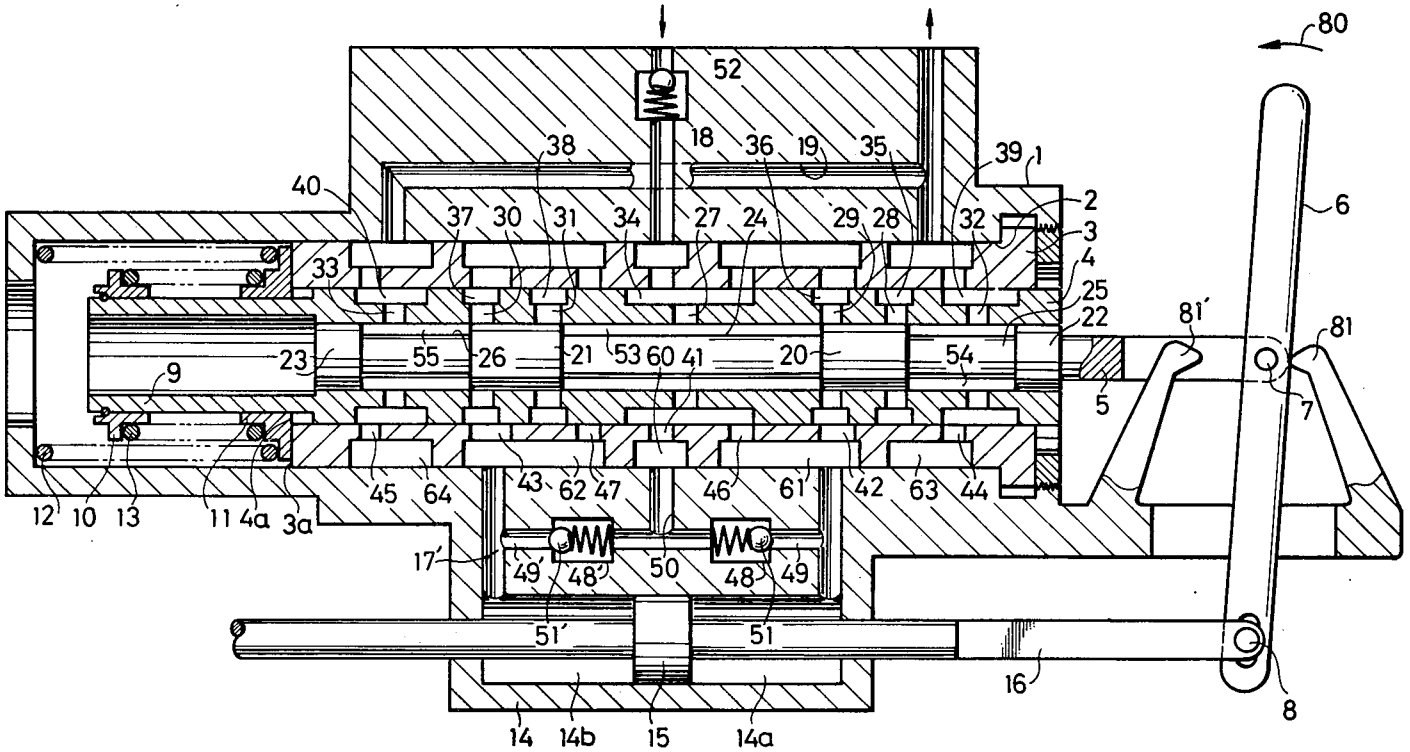
FIG. 3 is a cross-sectional view similar to FIG. 1 but showing a null position in an abnormal condition thereof under which the valve spool is stuck to the second sleeve in the state shown in FIG. 1 and the second sleeve is moved rightwardly in unison with the valve spool.

In order to ensure that the piston rod 16 is moved leftwardly under such a condition as shown in FIG. 1 that the valve spool 5 is jammed or stuck to the second sleeve 4, it is required to swing the input lever 6 around the pin member 8 in the direction opposite to the arrow 80 to concurrently move the second sleeve 4 and the valve spool 5 rightwardly until the input lever 6 is brought into engagement with the stop member 81 as shown in FIG. 3. Under these conditions, the pressure oil is admitted into the right chamber 14*a* of the cylinder 14 from the inlet conduit 18 through the check valve 52, the eighth annular groove 60, the radial bores of the eighth port group 41, the first annular groove 34, the radial bores of the thirteenth port group 46, the ninth annular groove 61, and the cylinder conduit 17, while the pressure oil in the left chamber 14*b* of the cylinder 14 is not discharged from the cylinder conduit 17' since the radial bores of the fourth port group 30 are closed by the large diameter portion 21. Therefore, the piston rod 16 is not moved in any direction under the conditions. In order to leftwardly move the piston rod 16, the input lever 6 is further swung around the stop member 81 in the direction opposing to the arrow 80. At this time, the pressure oil in the left chamber **14*b* of the cylinder 14 comes to be higher in pressure than that in the right chamber 14*a* of the cylinder 14 to open the check valve 51' so that the pressure oil in the cylinder conduit 17' is passed through the by-pass conduits 49' and 50, the eighth annular groove 60, the radial bores of the eighth port group 41, the first annular groove 34, the radial bores of the thirteenth port group 46, the ninth annular groove 61 and the cylinder conduit 17 and then is admitted into the right chamber 14*a* of the cylinder 14, thereby causing the piston rod 16 to be moved leftwardly. When an external force to move the piston rod 16 rightwardly is exerted thereupon at this time, the pressure oil is not forced to be discharged by the action of the external force and thus the piston rod 16 is not moved rightwardly to discharge the pressure oil from the right chamber 14*a* of the cylinder 14 since the check valves 51 and 52 are closed even if the pressure oil in the right chamber 14*a* of the cylinder 14 becomes higher in pressure than the pressure oil supplied into the inlet conduit 18 from the pressure source. When the external force to move the piston rod 16 leftwardly is on the other hand exerted thereupon, the input lever 6 is swung around the upper end thereof, and the second sleeve 4 and the valve spool 5 is leftwardly moved in unison with each other and the first and second sleeves 3 and 4 resume the null position as shown in FIG. 1. It is therefore to be noted that the piston rod 16 is not moved even with the external force exerted to rightwardly move the piston rod 16, while the second sleeve 4 and the valve spool 5 are moved to and stopped at the state where the first and second sleeves 3 and 4 retain the null position shown in FIG. 1** even if the piston rod is leftwardly moved by the external force, resulting in the irreversible effect.

In order to rightwardly move the piston rod 16 when the valve spool 5 and the second sleeve 4 are stuck to each other under the state shown in FIG. 1, it is required to swing the input lever 6 in the direction of the arrow 80 as shown in FIG. 2.

Figure 4:
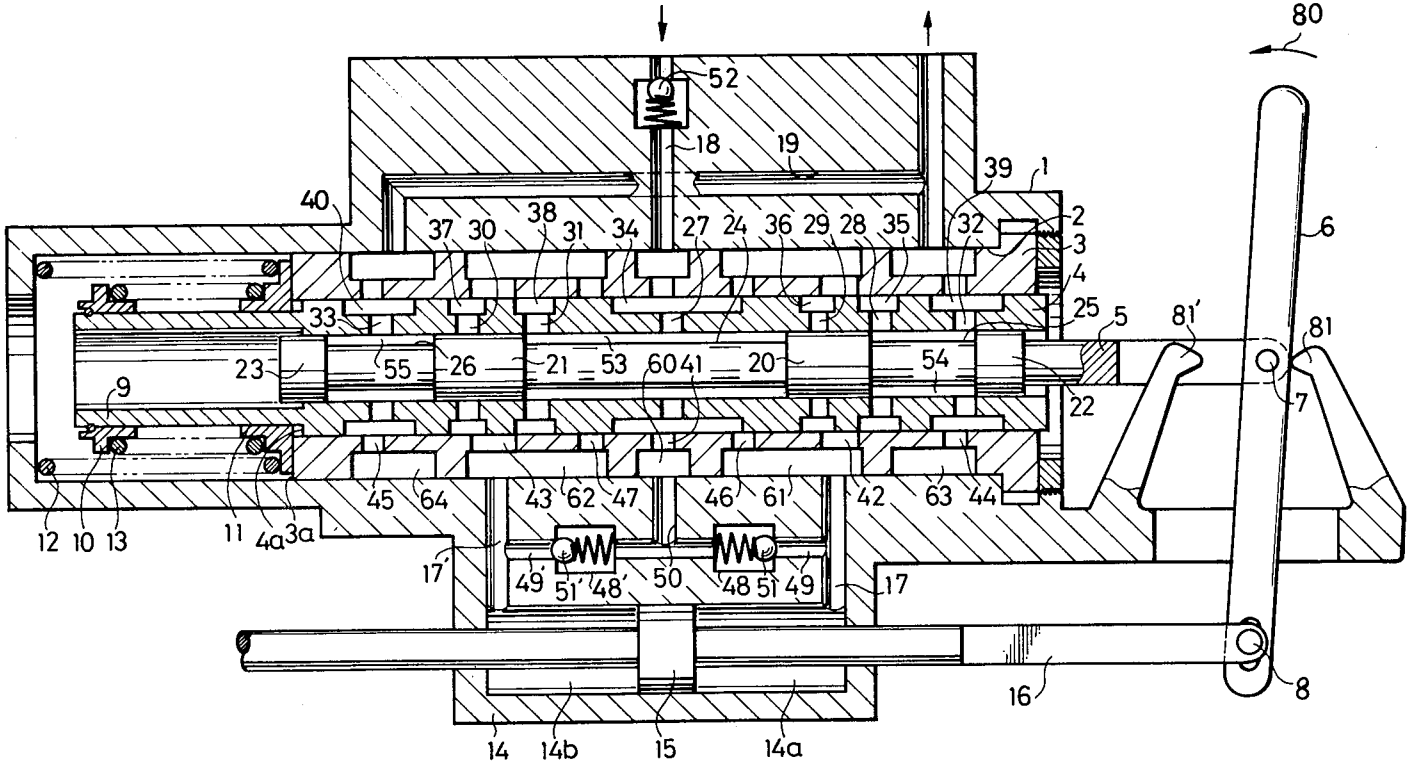
FIG. 4 is a cross-sectional view similar to FIG. 1 but showing a null position in an abnormal condition thereof under which the valve spool is stuck to the second sleeve in the state shown in FIG. 2 and the second sleeve is moved rightwardly in unison with the valve spool.

When the valve spool 5 is stuck to the second sleeve 4 as shown in FIG. 2 under the state that the valve spool 5 has been moved leftwardly of the position shown in FIG. 1, the piston rod 16 is required to be moved rightwardly in the manner as will be described hereinafter. The input lever 6, which may be inclined in any suitable angle is swung around the upper end forcedly stopped manually so as to concurrently move the second sleeve 4 and the valve spool 5 rightwardly until the left face of the second annular groove 35 is radially aligned with the right faces of the radial bores of the ninth port group 42 and the left face of the fifth annular groove 38 is radially aligned with the right faces of the radial bores of the tenth port group 43 as shown in FIG. 4. As a result of this, there is caused neither introduction nor discharge of the pressure oil for the cylinder 14, thereby stopping the piston 15 and the piston rod 16. Even when the external force to move the piston rod 16 rightwardly is exerted thereupon, the pressure oil in the right chamber **14*a* of the cylinder 14 is not discharged by the action of the check valves 51 and 52 so that the piston rod 16 is not moved in any direction. When the external force to move the piston rod 16 leftwardly is exerted thereupon, the pressure oil in the left chamber 14*b* of the cylinder 14 comes to be higher in pressure than that in the right chamber 14*a* of the cylinder 14, thereby causing the check valve 51' to be opened so that the pressure oil in the left chamber 14*b* of the cylinder 14 is discharged into the outlet conduit 19 through the by-pass conduit 49' and 50, the eighth annular groove 60, the radial bores of the eighth port group 41, the first annular groove 34, the radial bores of the thirteenth port group 46, the ninth annular groove 61, the radial bores of the ninth port group 42, the second annular groove 35, the radial bores of the second port group 28, the annular chamber 54, the radial bores of the sixth port group 32, the sixth annular groove 39, the radial bores of the eleventh port group 44, and the eleventh annular groove 63. Thus, the piston rod 16 is moved leftwardly and the second sleeve 4 is also moved leftwardly up to the relative positions of the first and second sleeves 3 and 4 as shown in FIG. 2. Upon release of the external force from the piston rod 16, the pressure oil is introduced into the left chamber 14*b* of the cylinder 14 while the pressure oil is discharged from the right chamber 14*a* of the cylinder 14 so that the piston 15 is forced to be moved up to and stopped at the position where the first and second sleeves 3 and 4 resume the relative positions as shown in FIG. 4**.

It is therefore to be noted that the piston rod 16 is not moved in any direction even when the external force to rightwardly move the piston rod 16 is exerted thereupon, and that after the external force to leftwardly move the piston rod 16 is exerted thereupon to be moved to their positions, where the first and second sleeves 3 and 4 resume the relative positions as shown in FIG. 2, by the input lever 6, the piston 15 is forced to be moved up to and stopped at the position, where the first and second sleeves 3 and 4 resume the relative positions shown in FIG. 4, upon the release of the external force from the piston rod 16. The irreversible effect can thus be obtained.

In order to rightwardly move the piston rod 16 from the state where the first and second sleeves 3 and 4 are positioned as shown in FIG. 4, the input lever 6 which may be inclined in any suitable angle, is swung around the pin member 8 in the direction of the arrow 80 to cause the first and second sleeves 3 and 4 to assume their positions shown in FIG. 2. At this time, the second annular groove 35 and the radial bores of the ninth port group 42 are brought into engagement with each other, while the fifth annular groove 38 and the radial bores of the tenth port group 43 are also brought into engagement with each other so that the pressure oil is introduced into the left chamber **14*b* of the cylinder 14 from the cylinder conduit 17' while the pressure oil is discharged from the right chamber 14*a* of the cylinder 14 through the cylinder conduit 17. As a consequence, the piston 15 and the piston rod 16 are rightwardly moved. When the piston rod 16 is moved rightwardly, the input lever 6 is caused to be swung around the upper end thereof to concurrently move the second sleeve 4 and the valve spool 5 rightwardly up to the positions where the first and second sleeves 3 and 4 assume their positions as shown in FIG. 4, whereupon the second sleeve 4, the valve spool 5, the piston 15 and the piston rod 16 stop their movement. On the other hand, to move the piston rod 16 leftwardly from the state where the first and second sleeves 3 and 4** assume their positions as shown in FIG. 4, the input lever 6 is swung around the pin member 8 in the direction opposing to the arrow 80 into engagement with the stop member 81 and thereafter further swung around the stop member 81 to leftwardly move the piston rod 16. When the external force to rightwardly move the piston rod 16 is exerted thereupon at this time, the pressure oil in the right chamber 14a of the cylinder 14 is not discharged by the action of the check valve 51' and 52 and thus the piston rod 16 is not moved in any direction. When the external force to leftwardly move the piston rod 16 is exerted thereupon at this time, the input lever 6 is swung around the upper end thereof to bring the first and second sleeves 3 and 4 into their positions shown in FIG. 2, causing the external force and the pressure oil to be balanced. Upon releasing the external force, the relative positions of the first and second sleeves 3 and 4 are returned from the state of FIG. 2 to the state of FIG. 4, whereupon the piston rod 16 is stopped causing the irreversible effect.

When the valve spool 5 is stuck to the second sleeve 4 under such a condition that the radial bores of the second port group 28 are closed and the radial bores of third port group 29 are opened by the large diameter portion 20 of the valve spool 5 while the radial bores of the fifth port group 31 are closed and the radial bores of the fourth port group are opened by the large diameter portion 21 of the valve spool 5, the leftward and rightward movements of the piston rod 16 and the movements of the piston rod 16, the valve spool 5 and the second sleeve 4 upon their feed-back are carried out in an entirely opposite manner to the above, all resulting in the irreversible effect.

In the event that there is no pressure oil to be supplied to the inlet conduit 18 due to troubles in the pressure oil source under the condition shown in FIG. 1, the piston rod 16 is required to be moved leftwardly and rightwardly in such operations as follows.

When the piston rod 16 is firstly required to be moved rightwardly, the input lever 6 is swung around the pin member 8 in the direction of the arrow 80 into engagement with the stop member 81' and thereafter is further swung around the stop member 81' to move the piston rod 16 rightwardly. When the piston rod 16 is then required to be moved leftwardly, the input lever 6 is swung around the pin member 8 in the direction opposing to the arrow 80 into engagement with the stop member 81 and thereafter is further swung around the stop member 81 to move the piston rod 16 leftwardly. At this time, the leftward and rightward movements of the valve spool 5 are not entirely varied even in the case of whether the valve spool 5 is stuck to the second sleeve 4 or not. The irreversible effect at the time when there is no pressure oil to be supplied through the inlet conduit 18 due to the troubles of the oil pressure source will be caused in the same manner as the above by the action of the check valves 51, 51' and 52 or of the feed-back mechanism in which the valve spool 5 and the piston rod 16 are connected with each other by means of the input lever 6.

While there has been described in the above embodiment about the leftward and rightward movements of the piston rod 16 with the housing 1 kept stationary, the housing 1 may inversely be moved leftwardly and rightwardly with the piston rod 16 kept stationary, if desired. The relative positions and movements of the cylinder 14 and the piston 15, the piston rod 16 may be modified as follows.

Each of the embodiments of FIGS. 5–8 include a feedback arrangement returning the valve means to a null position.

Figure 5:
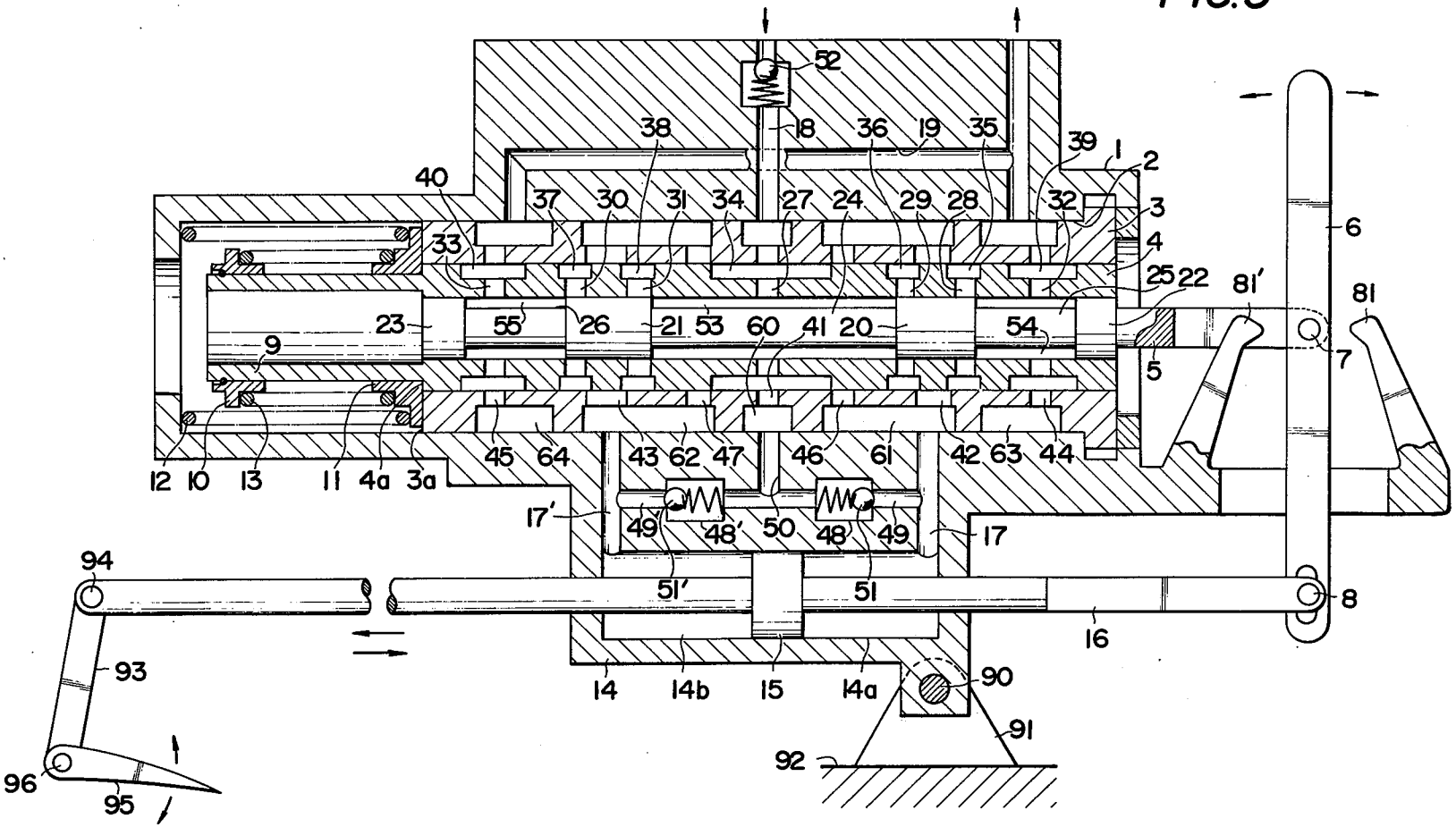
FIGS. 5–8 are similar views to FIG. 1 but show other embodiments of the present invention.

In FIG. 5, the cylinder 14 is pivotally connected by a pivotal pin 90 to a bracket 91 which is rigidly connected to a suitable stationary frame 92. A link 93 has one end pivotally connected to the free end of the piston rod 16 through a pivotal pin 94 and the other end also pivotally connected to one end of a flapper or elevator 95 through a stationary pivotal pin 96 so that the free end of the flapper 95 is moved up and down through the link 93 by the reciprocal movement of the piston rod 16.

Figure 6:
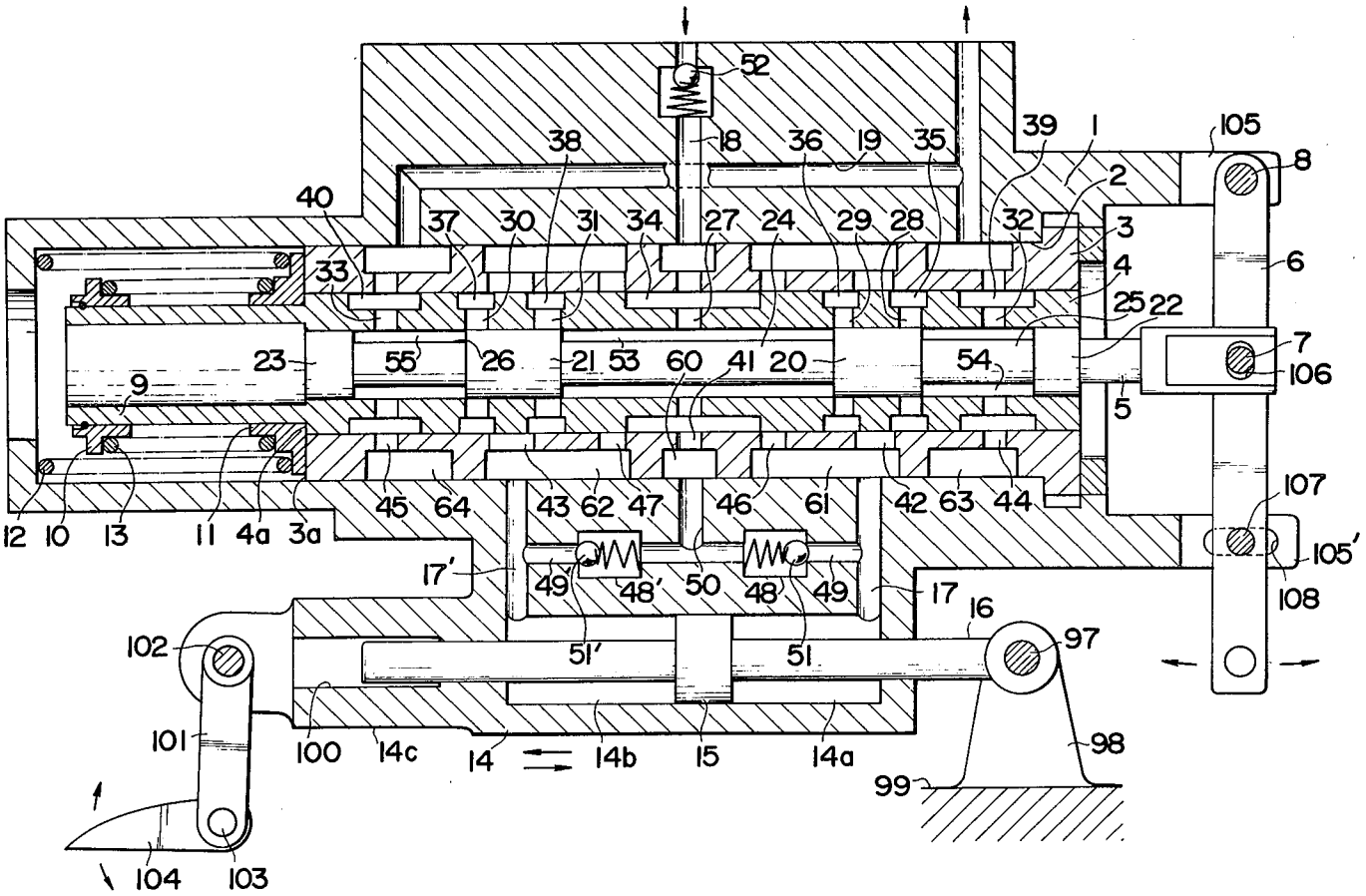

In FIG. 6, the piston rod has one end pivotally connected through a pivotal pin 97 to a bracket 98 which is rigidly connected to a suitable stationary frame 99 and the other end slidably received in an axial bore 100 which is formed in a protrusion 14c integrally attached to the side of the cylinder 14. A link 101 is pivotally connected at one end through a pivotal pin 102 to the free end of the protrusion 14c and at the other end through a stationary pivotal pin 103 to one end of a flapper or elevator 104 so that the free end of the flapper 104 is moved up and down through the link 101 by the reciprocal movement of the cylinder 14. A pair of furcated projections 105 and 105' are integrally formed at the side of the housing 1 in spaced relation with the free end of the valve spool 5 which has a slot 106 extending perpendicularly to the axis of the valve spool 5. An input lever 6 is pivotally connected at one end through a pivotal pin 8 to the projection 105, having a first longitudinally intermediate portion pivotally connected through a pivotal pin 7, inserted in the slot 106, to the free end of the valve spool 5 which having a second longitudinally intermediate portion fixedly supporting a pin 107. A pair of arcuate slots 108 one of which is shown in FIG. 6 are formed in the projections 105' to slidably receive the pin 107. The swinging motion of the input lever 6 causes the valve spool 5 to be reciprocably moved until the pin 107 is stopped at the extremest ends of the arcuate slots 108.

Figure 7:
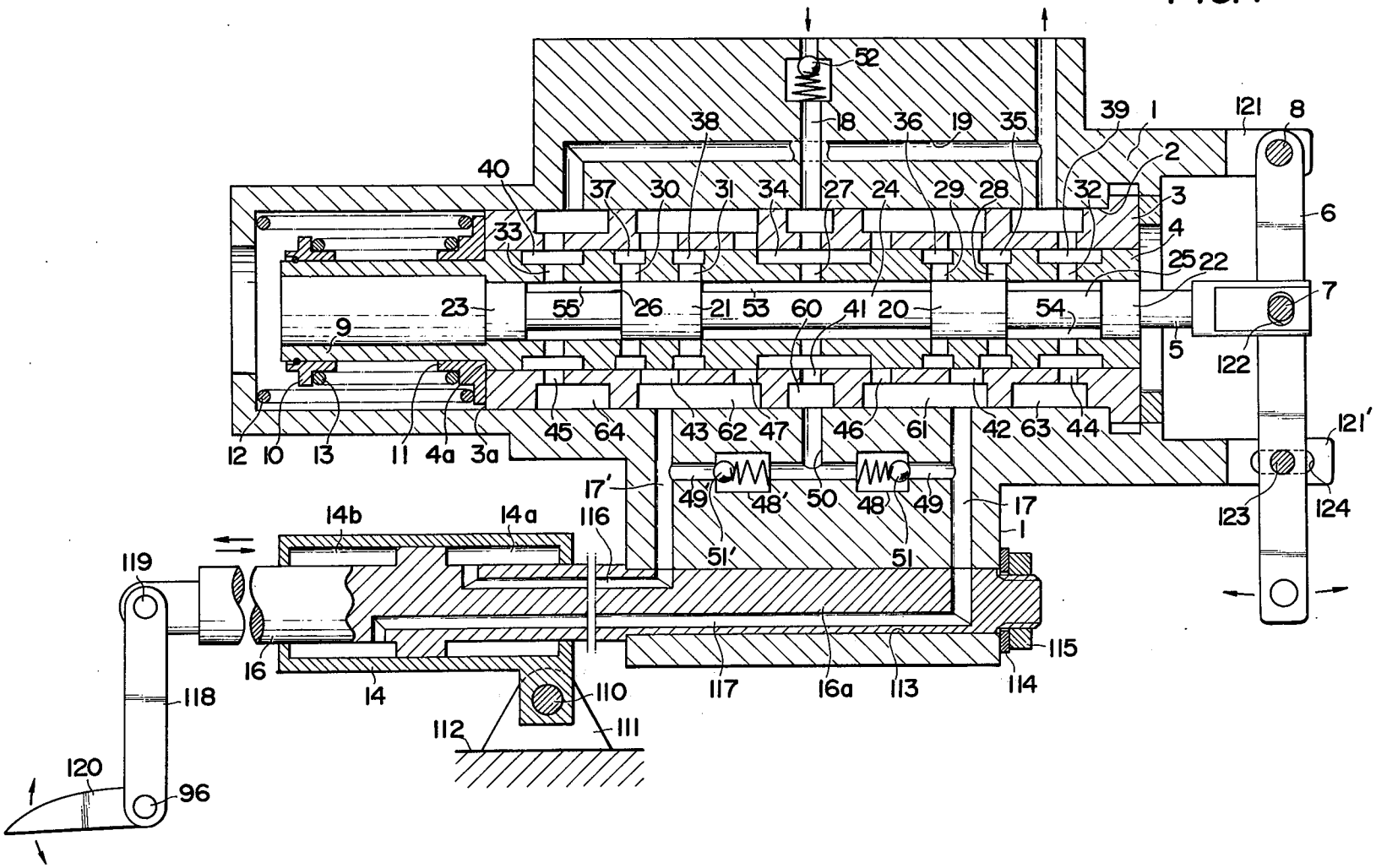

In FIG. 7, the cylinder 14 is pivotally connected through a pivotal pin 110 to a bracket 111 rigidly connected to a suitable stationary frame 112. The piston rod 16 has a longitudinal portion 16a tightly received in a bore 113 formed in the housing 1 and is securely connected with the housing 1 by means of a washer 114 and a nut 115. A conduit 116 is formed in the piston rod 16 to have one end in communication with the cylinder conduit 17' and the other end opened at the right chamber 14a of the cylinder 14. Another conduit 117 is formed in the piston rod 16 to have one end in communication with the cylinder conduit 17 and the other end opened at the left chamber 14b of the cylinder 14. Therefore, alternative admission and discharge of the pressure oil into and from the right and left chambers 14a and 14b cause the housing 1 to be moved in opposite directions through the piston rod 16. A link 118 has one end pivotally connected to the free end of the piston rod 16 by a pivotal pin 119 and the other end also pivotally connected to one end of a flapper or elevator 120 through a stationary pivotal pin 96 so that the free end of the flapper 120 is moved up and down through the link 118 by reciprocal movement of the piston rod 16. A pair of furcated projections 121 and 121' are integrally formed at the side of the housing 1 in spaced relation with the free end of the valve spool 5 which has a slot 122 extending perpendicularly to the axis of the valve spool 5. An input lever 6 is pivotally connected at one end through a pivotal pin 8 to the projection 121, having a first longitudinally intermediate portion pivotally connected through a pivotal pin 7, inserted in the slot 122, to the free end of the valve spool 5 while having a second longitudinally intermediate portion fixedly supporting a pin 123. A pair of arcuate slots 124 one of which is shown in FIG. 7 are formed in the projections 121' to slidably receive the pin 123. The swinging motion of the input lever 6 causes the valve spool 5 to be reciprocably moved until the pin 123 is stopped at the extremest ends of the arcuate slots 124.

Figure 8:
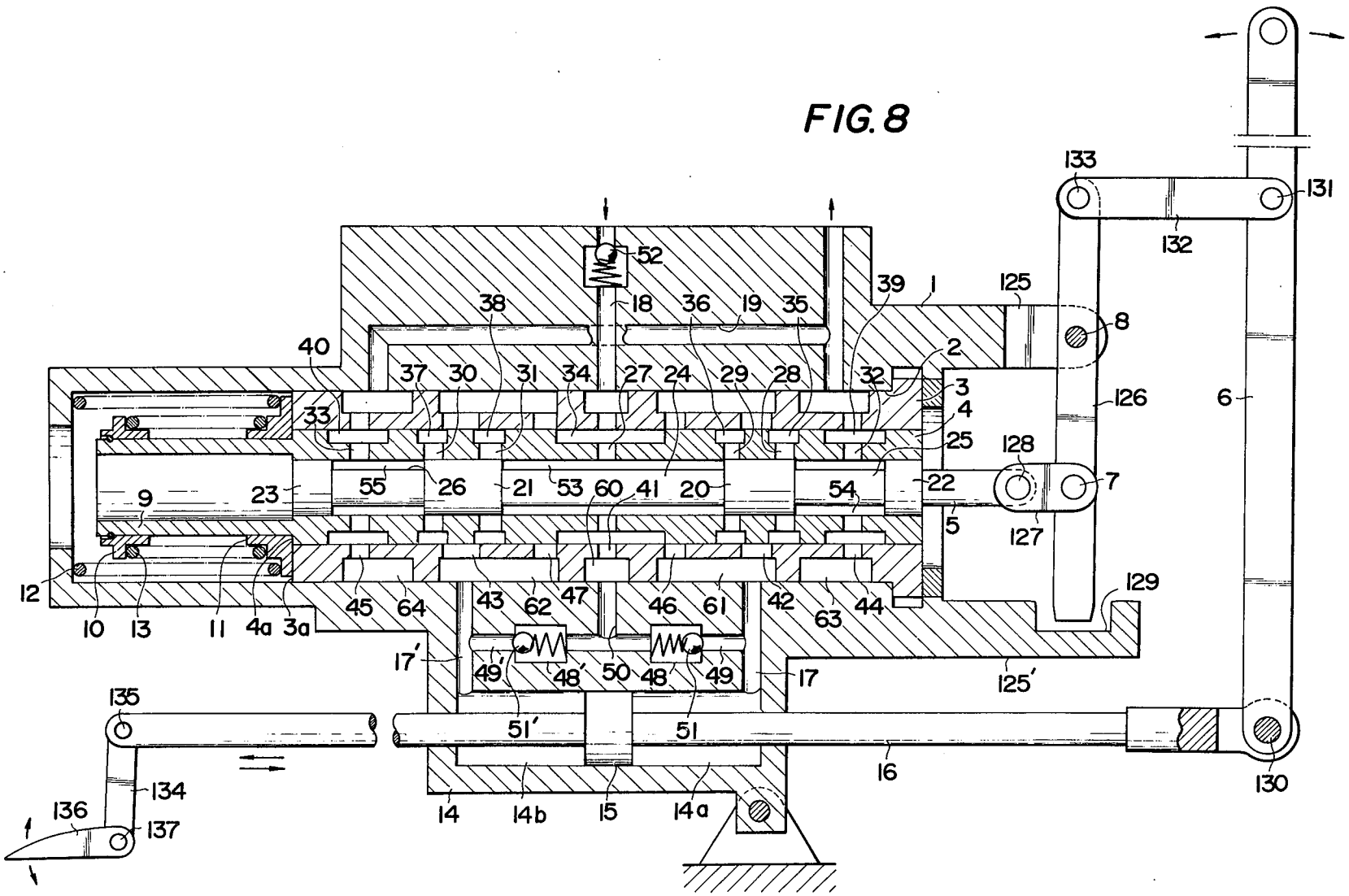

In FIG. 8, a pair of projections 125 and 125' are integrally formed at the side of the housing 1 in spaced relation with the free end of the valve spool 5. A link 126 is pivotally connected at its first longitudinally intermediate portion through a pivotal pin 8 to the projection 125, having a second longitudinally intermediate portion pivotally connected through a pivotal pin 7 to one end of a link 127 which has the other end pivotally connected through a pivotal pin 128 to the free end of the valve spool 5. One end of the link 126 is received in a recess 129 to be swingable in a predetermined angle range, the recess 129 being formed in the projection 125'. An input lever 6 has one end pivotally connected through a pin 130 to one end of the piston rod 16 and a longitudinally intermediate portion pivotally connected through a pivotal pin 131 to one end of a link 132 which is pivotally connected at the other end through a pivotal pin 133 to the other end of the link 126. Therefore, the swinging motion of the input lever 6 causes the valve spool 5 and the piston rod 16 to be reciprocably moved. A link 134 has one end pivotally connected to the free end of the piston rod 16 through a pivotal pin 135 and the other end also pivotally connected to one end of a flapper or elevator 136 through a stationary pivotal pin 137 so that the free end of the flapper 136 is moved up and down through the link 134 by the reciprocal movement of the piston rod 16.

It is to be understood from the above disclosure that the fail-safe fluid control valve of the present invention can be operated with the irreversible effect even in such the primary troubles that the valve spool is stuck to the second sleeve or even in such the secondary troubles of the pressure oil source, so that the attendant operator can operate the control valve without any operational failure.

Although particular embodiments of the present invention have been shown and described, it will be obvious to those skilled in the art that various changes and modifications may be made without departing from the spirit and scope of the present invention.

What is claimed is:

1. A fail-safe fluid control valve comprising:

a housing formed with a hollow cavity therein, a first sleeve securely accommodated in said hollow cavity of said housing, a second sleeve slidably accommodated in said first sleeve, a valve spool slidably accommodated in said second sleeve, resilient means provided in said housing for resiliently retaining said second sleeve at a predetermined position and for resiliently returning said second sleeve to said predetermined position when said second sleeve is moved away from said predetermined position, a cylinder disposed in the vicinity of said hollow cavity of said housing and having a piston with a piston rod therein, an inlet conduit communicated with said hollow cavity and having a first check valve to permit oil under pressure to be admitted into said hollow cavity through said check valve, a bifurcated outlet conduit communicated with said hollow cavity to permit the oil to be discharged from said hollow cavity, a pair of cylinder conduits each connecting one side of said cylinder to said hollow cavity to permit the oil to be admitted into said cylinder from said hollow cavity and to be discharged from said cylinder to said hollow cavity whereby relative movement between said piston and piston rod and said cylinder will be effected, the improvement comprising:

said valve spool including first, second, third and fourth large diameter portions located at predetermined intervals along its axial length so as to define a first small diameter portion between said first and second large diameter portions, a second small diameter portion between said first and third large diameter portions, and a third small diameter portion between said second and fourth large diameter portions, said second sleeve including a first port group located in opposing relation with said first small diameter portion of said valve spool and having at least one radial bore formed in said second sleeve, second and third port groups located in close proximity with each other and each having at least one radial bore formed in said second sleeve, the radially inner openings of said radial bores of said second and third port groups being closable by the outer peripheral surface of said first large diameter portion of said valve spool, fourth and fifth port groups located in close proximity with each other and each having at least one radial bore formed in said second sleeve, said fourth and fifth port groups being in spaced relation with said second and third port groups and the radially inner openings of said radial bores of said fourth and fifth port groups being closable by the outer peripheral surface of said second large diameter portion of said valve spool and being so closed when the radially inner openings of said radial bores of said second and third port groups are closed by the outer peripheral surface of said first large diameter portion of said valve spool, a sixth port group located in opposing relation with said second small diameter portion of said valve spool and having at least one radial bore formed in said second sleeve, a seventh port group located in opposing relation with said third small diameter portion of said valve spool and having at least one radial bore formed in said second sleeve, a first annular groove formed in the outer peripheral wall of said second sleeve to be in fluid communication with the radially outer opening of said radial bore of said first port group, a second annular groove formed in the outer peripheral wall of said second sleeve to be in fluid communication with the radially outer opening of said radial bore of said second port group, a third annular groove formed in the outer peripheral wall of said second sleeve to be in fluid communication with the radially outer opening of said radial bore of said third port group, a fourth annular groove formed in the outer peripheral wall of said second sleeve to be in fluid communication with the radially outer opening of said radial bore of said fourth port group, a fifth annular groove formed in the outer peripheral wall of said second sleeve to be in fluid communication with the radially outer opening of said radial bore of said fifth port group, a sixth annular groove formed in the outer peripheral wall of said second sleeve to be in fluid communication with the radially outer opening of said radial bore of said sixth port group, a seventh annular groove formed in the outer peripheral wall of said second sleeve to be in fluid communication with the radially outer opening of said radial bore of said seventh port group, said first sleeve including an eighth port group having at least one radial bore formed in said first sleeve with its radially inner opening in fluid communication with said first annular groove, a ninth port group having at least one radial bore formed in said first sleeve with its radially inner opening in fluid communication with said second and third annular grooves upon said second sleeve being retained at the predetermined position by said resilient means, a tenth port group having at least one radial bore formed in said first sleeve with its radially inner opening in fluid communication with said fourth and fifth annular grooves upon said second sleeve being retained at the predetermined position by said resilient means, an eleventh port group having at least one radial bore formed in said first sleeve with its radially inner opening in fluid communication with said sixth annular groove, a twelfth port group having at least one radial bore formed in said first sleeve with its radially inner opening in fluid communication with said seventh annular groove, a thirteenth port group having at least one radial bore formed in said first sleeve with its radially inner opening closed by the outer peripheral wall of said second sleeve and said radial bore of said thirteenth port group having an inner side, said inner side being closely adjacent said eighth port group, said first annular groove having an inner face substantially radially aligned with said inner side upon the second sleeve being retained at the predetermined position by said resilient means, a fourteenth port group having at least one radial bore formed in said first sleeve with its radially inner opening closed by the outer peripheral wall of said second sleeve and said radial bore of said fourteenth port group having an inner side, said inner side of said radial bore of said fourteenth port group being closely adjacent to said eighth port group, said first annular groove having another inner face substantially radially aligned with said inner side of said radial bore of said fourteenth port group upon the second sleeve being retained at the predetermined position by said resilient means, an eighth annular groove formed in the outer peripheral wall of said first sleeve to be in fluid communication with the radially outer opening of said radial bore of said eighth port group, a ninth annular groove formed in the outer peripheral wall of said first sleeve to be in fluid communication with the radially outer openings of said radial bores of said ninth and thirteenth port groups and one of said cylindrical conduits, a tenth annular groove formed in the outer wall of said first sleeve to be in fluid communication with the radially outer openings of said radial bores of said tenth and fourteenth port groups and said remaining cylinder conduit, an eleventh annular groove formed in the outer peripheral wall of said first sleeve to be in fluid communication with the radially outer opening of said radial bore of said eleventh port group and said outlet conduit, and a twelfth annular groove formed in the outer peripheral wall of said first sleeve to be in fluid communication with the radially outer opening of said radial bore of said twelfth port group and said outlet conduit, a by-pass conduit connected with said cylinder conduits and accommodating therein a pair of second check valves, said by-pass conduit being in fluid communication at its longitudinal position between said check valves with said eighth annular groove of said first sleeve.

2. The fail-safe fluid control valve as claimed in claim 1, which further comprises means for axially moving said valve spool in said housing over a predetermined distance, said means including an arm member having a portion thereof pivotally connected to said valve spool and another portion thereof pivotally connected to said piston rod.

3. The fail-safe fluid control valve as claimed in claim 1, which further comprises means for axially moving said valve spool in said housing over a predetermined distance, said means including an arm member having a portion thereof pivotally connected to said valve spool and another portion thereof pivotally connected to said housing.

4. The fail-safe fluid control valve as claimed in claim 1, which further comprises means for axially moving said valve spool in said housing, said means including a lever arm having one end pivotally mounted on said housing and an intermediate portion pivotally secured to said valve spool.

5. The fail-safe fluid control valve as claimed in claim 1, which further comprises means for axially moving said valve spool in said housing over a predetermined distance, said means including a first lever means having opposite ends and an intermediate portion pivotally connected to said housing and another portion pivotally connected to said valve spool, a second lever means having one end pivotally connected to said piston rod and a pivotal connection to one end of said first lever means intermediate the ends of said second lever means.

* * * * *